US008208839B2

(12) United States Patent
Mase et al.

(10) Patent No.: US 8,208,839 B2
(45) Date of Patent: Jun. 26, 2012

(54) DEVELOPER CARTRIDGE, DEVELOPING DEVICE, AND PROCESS CARTRIDGE

(75) Inventors: Soichiro Mase, Handa (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 751 days.

(21) Appl. No.: 12/210,296

(22) Filed: Sep. 15, 2008

(65) Prior Publication Data

US 2009/0087222 A1 Apr. 2, 2009

(30) Foreign Application Priority Data

Oct. 2, 2007 (JP) ..... 2007-258569

(51) Int. Cl.
*G03G 15/08* (2006.01)

(52) U.S. Cl. ..... 399/263; 399/256

(58) Field of Classification Search ..... 399/263, 399/254–256, 262

See application file for complete search history.

(56) References Cited

U.S. PATENT DOCUMENTS

| | | | | |
|---|---|---|---|---|
| 5,867,756 | A | 2/1999 | Suzuki et al. | |
| 7,260,346 | B2 * | 8/2007 | Himes | 399/262 |
| 7,702,263 | B2 | 4/2010 | Sato | |
| 7,742,726 | B2 * | 6/2010 | Mase et al. | 399/263 |
| 7,881,633 | B2 * | 2/2011 | Sakuma | 399/263 |
| 2007/0071503 | A1 | 3/2007 | Sato | |
| 2007/0189811 | A1 * | 8/2007 | Sato | 399/254 |
| 2007/0212120 | A1 | 9/2007 | Sato | |
| 2008/0205940 | A1 * | 8/2008 | Mase et al. | 399/263 |
| 2008/0240790 | A1 * | 10/2008 | Nishiyama et al. | 399/254 |
| 2009/0087226 | A1 * | 4/2009 | Yamazaki et al. | 399/263 |
| 2009/0087227 | A1 * | 4/2009 | Takagi et al. | 399/263 |

FOREIGN PATENT DOCUMENTS

| | | | |
|---|---|---|---|
| JP | 5-158345 | A | 6/1993 |
| JP | 06-019309 | | 1/1994 |
| JP | 06-236108 | | 8/1994 |
| JP | 09-319201 | | 12/1997 |
| JP | 09-319202 | | 12/1997 |
| JP | 2000-242069 | | 9/2000 |
| JP | 2007-086325 | | 4/2007 |
| JP | 2007-212966 | A | 8/2007 |
| JP | 2007-240571 | A | 9/2007 |

OTHER PUBLICATIONS

JP Office Action dtd Jan. 24, 2012.

* cited by examiner

*Primary Examiner* — David Gray
*Assistant Examiner* — Rodney Bonnette
(74) *Attorney, Agent, or Firm* — Banner & Witcoff, Ltd.

(57) ABSTRACT

A developer cartridge includes a housing for accommodating developer, a rotation shaft rotatably supported by the housing and passing across an inside of the housing, a supply opening formed in a wall of the housing opposite in a diameter direction of the rotation shaft, a return opening formed in the wall of the housing at a position displaced from the supply opening in an axial direction of the rotation shaft, a first agitation blade supported by the rotation shaft and passing through a position opposite the return opening along an inner surface of the housing, and a second agitation blade supported by the rotation shaft and passing through a position opposite the supply opening along an inner surface of the housing, wherein the first agitation blade is configured to allow the developer returned through the return opening to flow into the housing.

12 Claims, 11 Drawing Sheets

DEVELOPER CARTRIDGE, DEVELOPING DEVICE, AND PROCESS CARTRIDGE

CROSS-REFERENCE TO RELATED APPLICATIONS

This application claims priority from Japanese Patent Application No. 2007-258569 filed on Oct. 2, 2007, the entire subject matter of which is incorporated herein by reference.

TECHNICAL FIELD

The present invention relates to a developer cartridge having a supply opening for supplying developer in a cartridge to a developing chamber and a return opening for returning developer from the developing chamber to the inside of the cartridge, and more particularly, to a developing device having the developer cartridge, a process cartridge, and an image forming apparatus.

BACKGROUND

In general, an image processing apparatus such as a laser printer includes a photosensitive drum having electrostatic latent images formed thereon, a process cartridge having a developing roller for supplying toner to the photosensitive drum, and a toner cartridge (developer cartridge) having toner accommodated therein. As an example of the image forming apparatus, JP-A-9-319202 discloses a configuration including a supply opening for supplying toner in a toner cartridge to a developing chamber, a toner cartridge having formed therein a return opening for returning toner from the developing chamber to the inside of the toner cartridge, an agitator having blades for agitating the interior of the toner cartridge, and an auger capable of conveying toner within the developing chamber at a supply opening side toward a return opening side. In the image forming apparatus, the toner agitated by the rotation of the agitator is discharged to the developing chamber through the supply opening, conveyed toward the return opening by the auger and then returned to the inside of the toner cartridge through the return opening. Therefore, by circulating the toner in this manner, it may be possible to suppress the toner from being left accumulated in the developing chamber.

SUMMARY

Aspects of the present invention provide a developer cartridge, a developing device, and a process cartridge capable of improving circulation of developer.

BRIEF DESCRIPTION OF THE DRAWINGS

FIGS. 7A and 7B are top views for illustrating an operation of the agitator, in which FIG. 7A shows the state wherein developer is accumulated on a supply opening side by an oblique agitation blade, and FIG. 7B shows the state wherein developer is delivered through the supply opening;

DETAILED DESCRIPTION

General Overview

According to an aspect of the present invention, there is provided a developer cartridge comprising: a housing configured to accommodate developer; a rotation shaft that is rotatably supported by the housing and passes across an inside of the housing; a supply opening formed in a wall of the housing opposite in a diameter direction of the rotation shaft; a return opening formed in the wall of the housing at a position displaced from the supply opening in an axial direction of the rotation shaft; a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to allow the developer returned through the return opening to flow into the housing.

According to another aspect of the present invention, there is provided a developer device comprising: the developer cartridge according to the above aspect; a developing chamber to which developer is supplied through a supply opening of the developer cartridge; a supply roller provided in the developing chamber; and a developing roller to which the developer is supplied from the supply roller.

According to still another aspect of the present invention, there is provided a process cartridge comprising: the developer device according to the above aspect; and a photosensitive drum to which the developer is supplied from the developing roller.

Exemplary Embodiments

Exemplary embodiments of the invention will be described with reference to the drawings.

The above described related art image forming apparatus has some disadvantages. For example, if the blades of the agitator are made of rectangular flexible sheet and a distal end of the blades is configured to pass through a position opposite a return opening while making sliding contact with an inner surface of a developer cartridge, some of the developer returned through the return opening to the inside of the developer cartridge may be forced back by the flexible sheet. In that case, the developer may not circulate smoothly.

Aspects of the present invention provide a developer cartridge, a developing device, and a process cartridge capable of improving circulation of developer.

First Example

Figure 1:
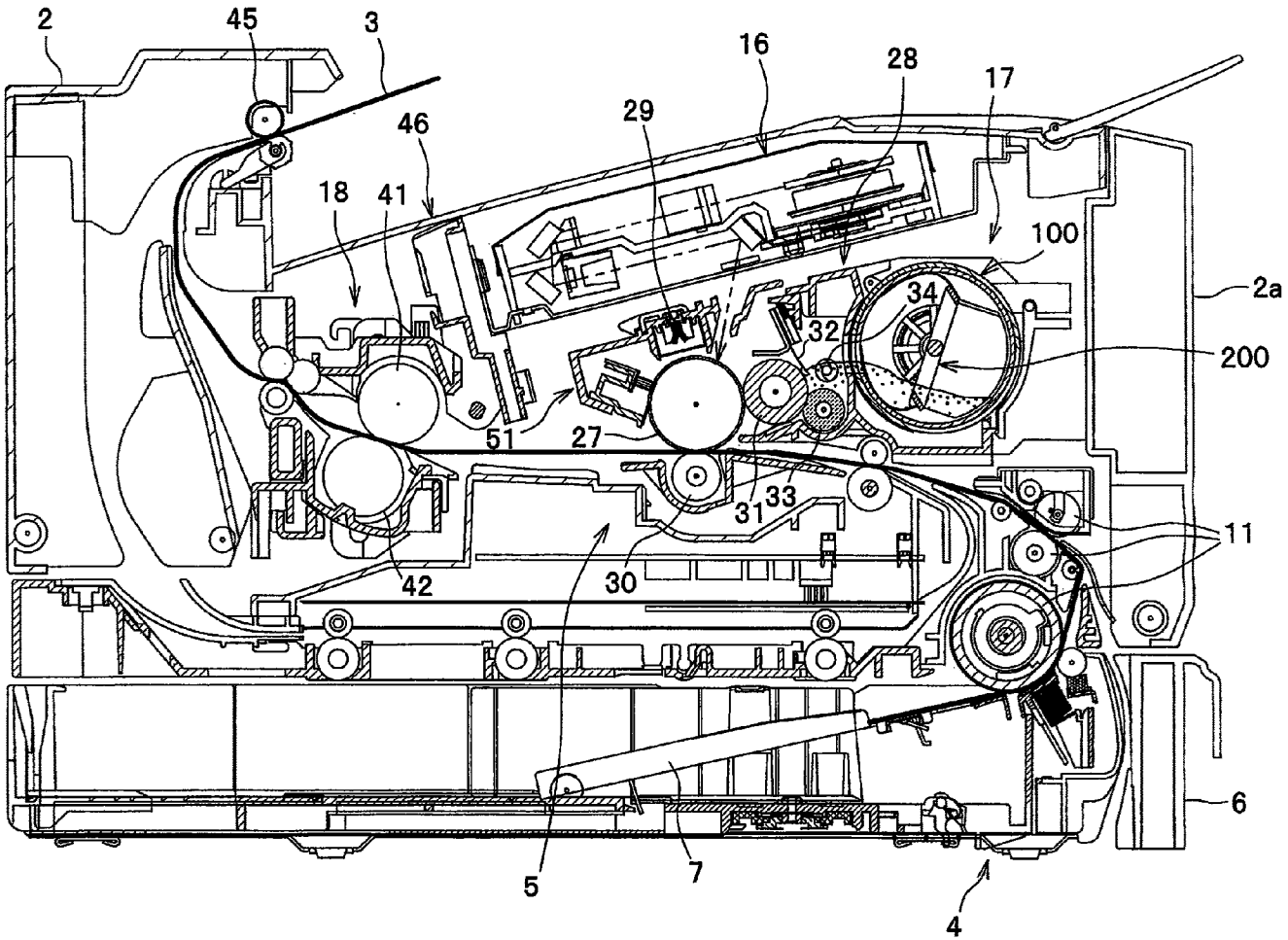
FIG. 1 is a side sectional view of an image forming apparatus according to a first example of the invention.

FIG. 1 is a side sectional view of an image forming apparatus according to a first example of the invention.

(1) Image Forming Apparatus

As shown in FIG. 1, an image forming apparatus 1 includes a main casing 2, a feeder unit 4 for conveying sheet 3, an image forming unit 5 for forming images on the sheet 3, and the like.

(2) Feeder Unit

The feeder unit 4 includes a sheet feed tray 6, a sheet pressing plate 7, and various rollers 11. In the feeder unit 4, the sheet 3 in the sheet feed tray 6 is moved upward by the sheet pressing plate 7 and conveyed to an image forming unit 5 by the various rollers 11.

(3) Image Forming Unit

The image forming unit 5 includes a scanner unit 16 as an example of an exposure unit, a process cartridge 17, a fixing unit 18, and the like.

(4) Scanner Unit

The scanner unit 16 includes a laser emitting part (not shown), a polygon mirror, lenses, and a reflection mirror (not denoted by reference numeral). In the scanner unit 16, a laser beam travels along a path indicated by a chain line in the drawing and is scanned and irradiated onto the surface of a photosensitive drum 27 in the process cartridge 17.

(5) Process Cartridge

The process cartridge 17 is detachably attached to the main casing 2 by opening a front cover 2*a*. The process cartridge 17 includes a developing cartridge 28 as an example of a developing device, and a drum unit 51, etc.

The developing cartridge 28 is configured to be detachable from the main casing 2 in a state where it is attached to the drum unit 51. The developing cartridge 28 may be configured to be detachable from the drum unit 51 that is fixed to the main casing 2.

The developing cartridge 28 includes a developing roller 31, a thickness regulation blade 32, a supply roller 33, and an auger 34. A developer cartridge 100 (which will be described later) is detachably attached to the developing cartridge 28. The developer in the developer cartridge 100 is agitated by an agitator 200 and is supplied to the developing roller 31 by the supply roller 33. At this time, the developer is positively charged by friction while being rubbed between the supply roller 33 and developing roller 31. Subsequently, with the rotation of the developing roller 31, the developer supplied onto the developing roller 31 is moved between the thickness regulation blade 32 and the developing roller 31, where the developer is then carried as a thin layer of a predetermined thickness on the developing roller 31.

The drum unit 51 includes a photosensitive drum 27, a scorotron charger 29, and a transfer roller 30. In the drum unit 51, the surface of the photosensitive drum 27 is uniformly charged with positive charges by the scorotron charger 29 and is thereafter exposed by the laser beam fast-scanned from the scanner unit 16. With this exposure, the electric potential at the exposed portion decreases and thus electrostatic latent images based on image data are formed on the exposed portion. Here, the term, "electrostatic latent images," refers to an exposed portion which is exposed by the laser beam and the electric potential of which is decreased, among portions on the surface of the photosensitive drum 27 which is uniformly charged with positive charges. Next, when the developer carried on the surface of the developing roller 31 is brought into opposing contact with the photosensitive drum 27 by the rotation of the developing roller 31, the developer carried on the surface of the developing roller 31 is supplied to the electrostatic latent images formed on the surface of the photosensitive drum 27. Then, the developer is selectively carried on the surface of the photosensitive drum 27 and changed to a visible image, whereby a developer image is formed by reversal development.

Thereafter, the photosensitive drum 27 and a transfer roller 30 are rotated to convey the sheet 3 pinched between them, and when the sheet 3 is conveyed while being pinched between the photosensitive drum 27 and the transfer roller 30, the developer image carried on the surface of the photosensitive drum 27 is transferred onto the sheet 3.

(6) Fixing Unit

The fixing unit 18 includes a heating roller 41 and a pressure roller 42. In the fixing unit 18, the developer transferred onto the sheet 3 is thermally fixed during the passage of the sheet 3 between the heating roller 41 and the pressure roller 42. Moreover, the sheet 3 thermally fixed in the fixing unit 18 is delivered to a sheet discharge tray 46 by a sheet discharge roller 45 disposed on the downstream side of the fixing unit 18.

(7) Developer Cartridge

Figure 2:
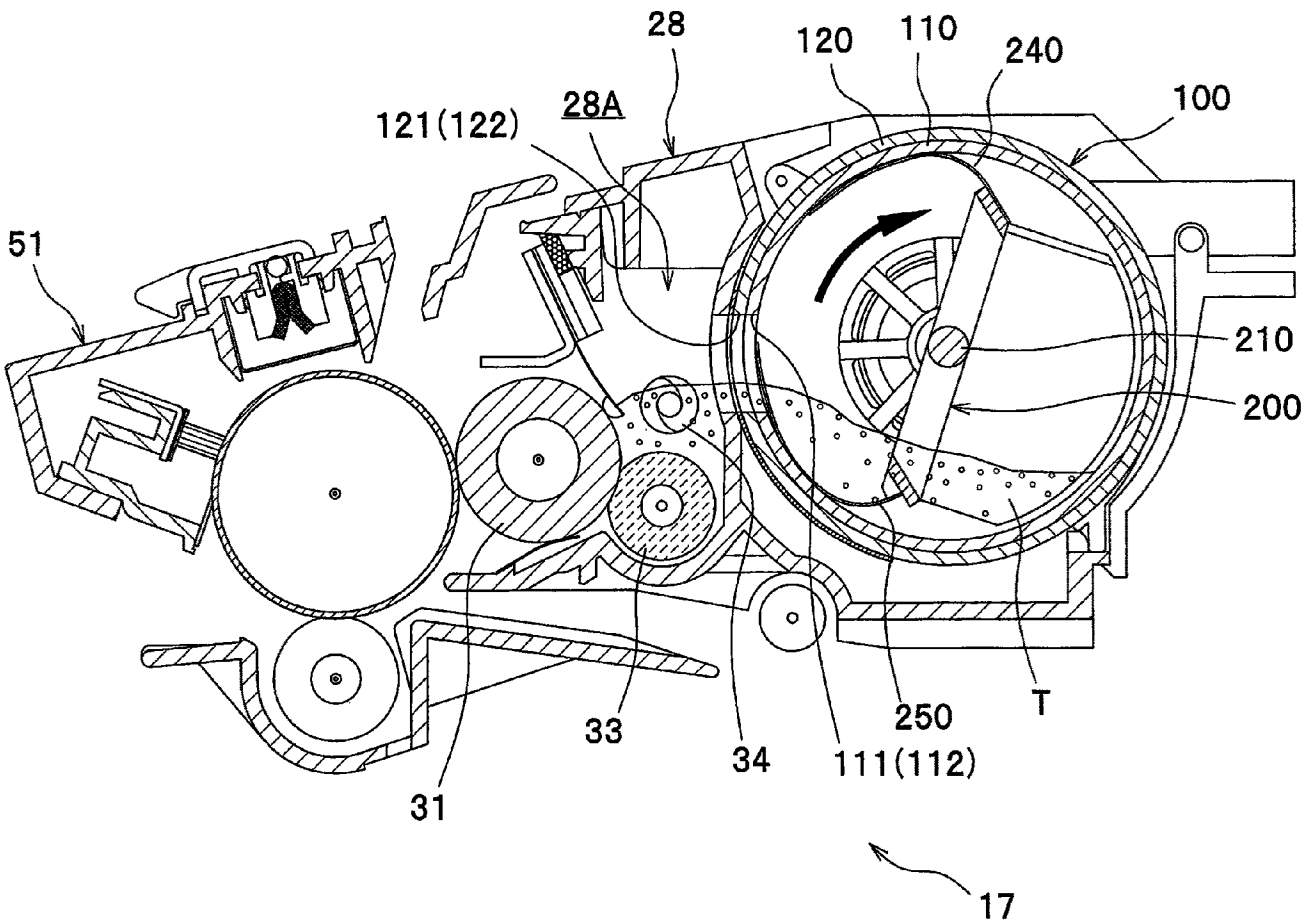
FIG. 2 is an enlarged sectional view illustrating a detailed structure of a developer cartridge.
Figure 3A:
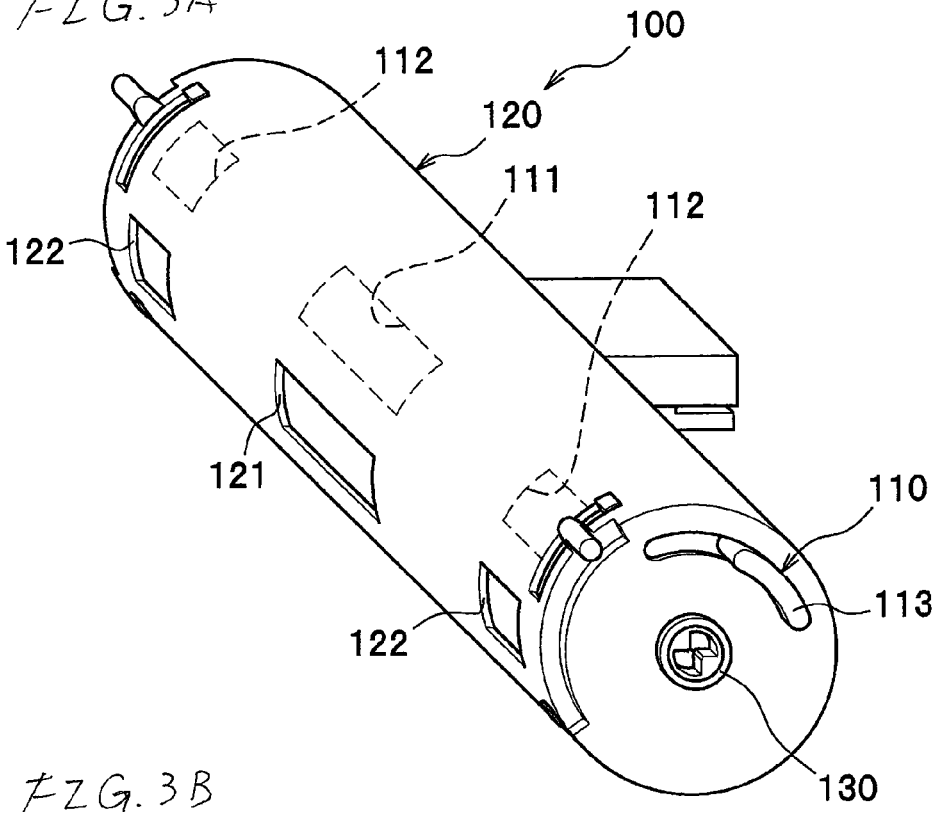
FIG. 3A is a perspective view of the developer cartridge in a closed state.
Figure 3B:
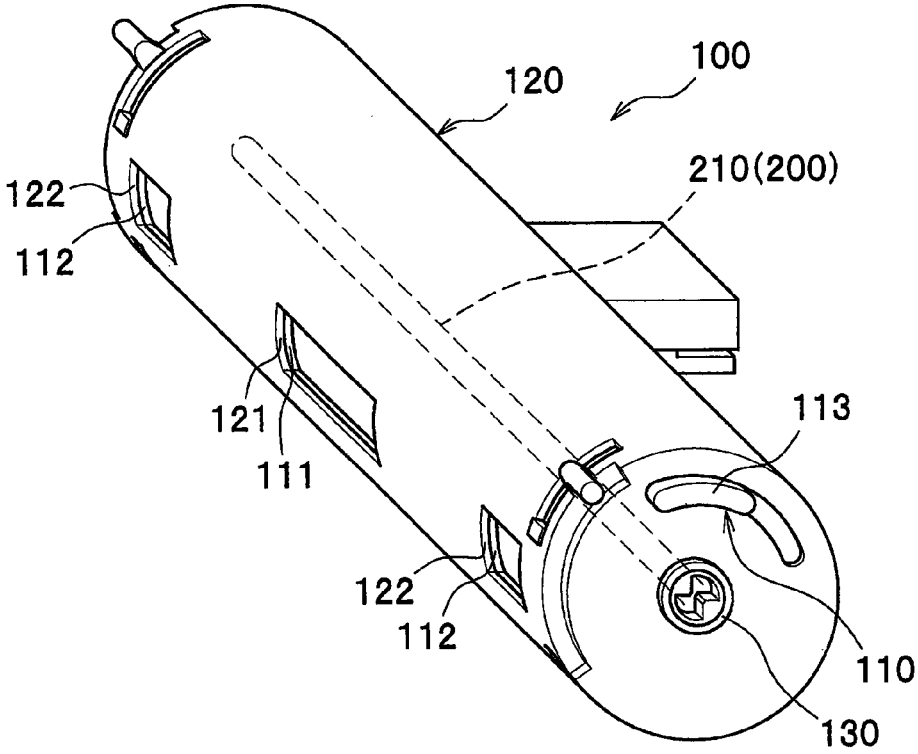
FIG. 3B is a perspective view of the developer cartridge in an open state.
Figure 4A:
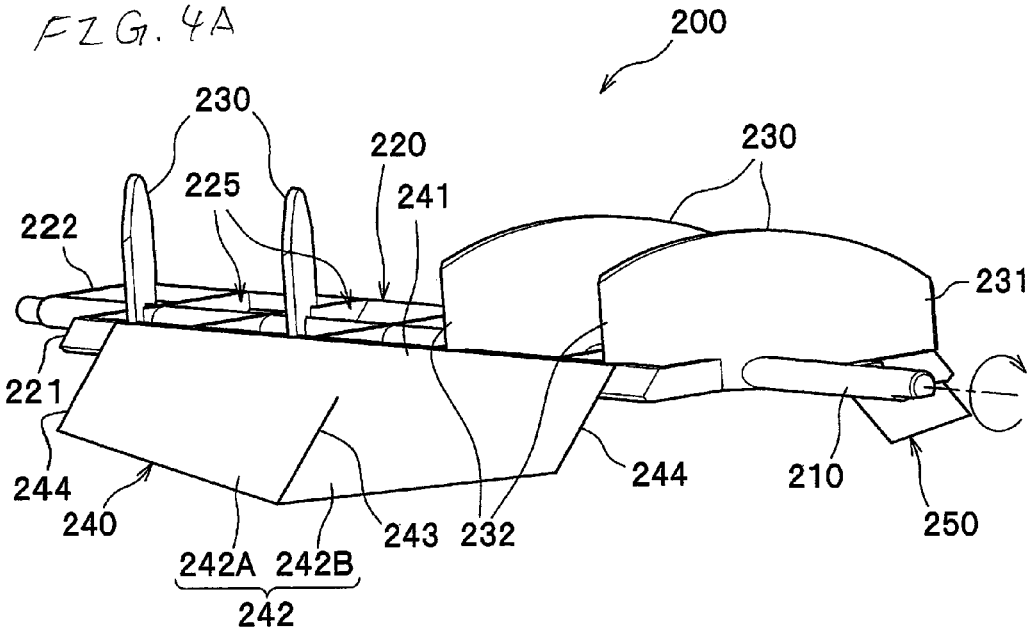
FIG. 4A is a perspective view of an agitator showing the state as viewed from an oblique agitation blade side.
Figure 4B:
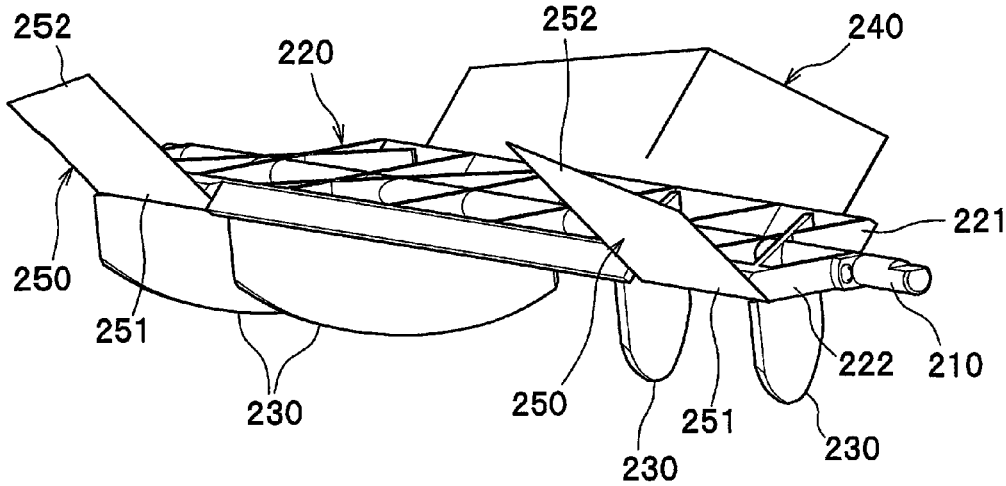
FIG. 4B is a perspective view of the agitator showing the state as viewed from a side opposite to the oblique agitation blade side.
Figure 5A:
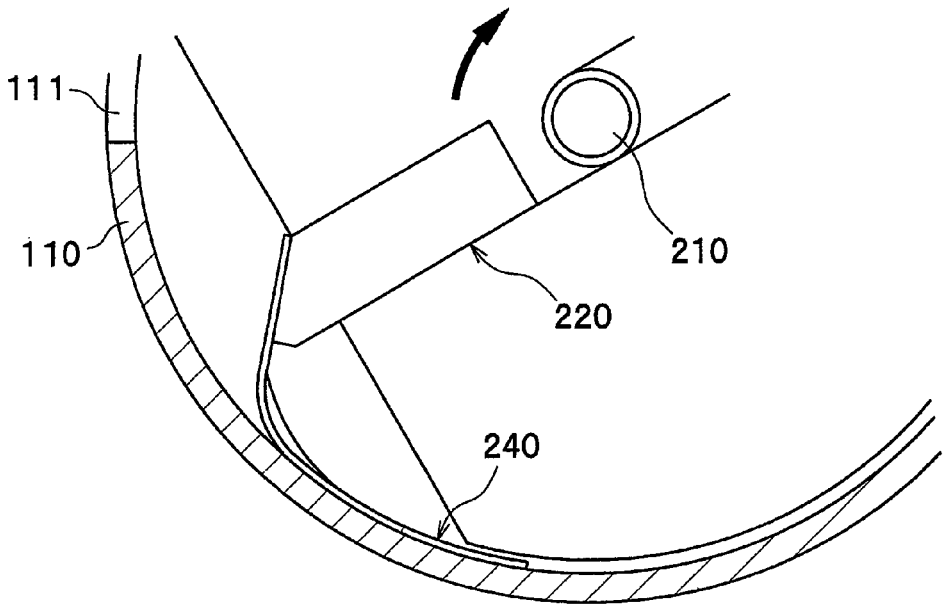
FIG. 5A is an enlarged sectional view of a delivery agitation blade showing the state where it is in sliding contact with an inner circumferential surface of an inside housing.
Figure 5B:
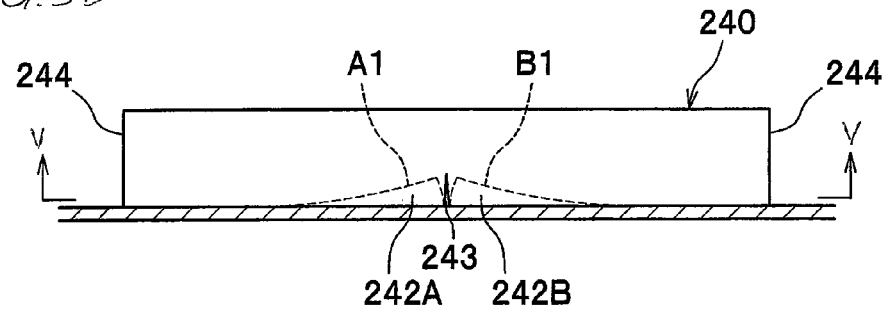
FIG. 5B is a top view of the delivery agitation blade showing the state as viewed from the above.
Figure 5C:
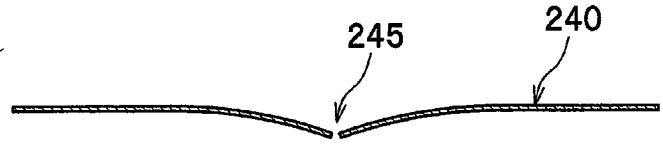
FIG. 5C is a sectional view taken along the line V-V in FIG. 5B.
Figure 6A:
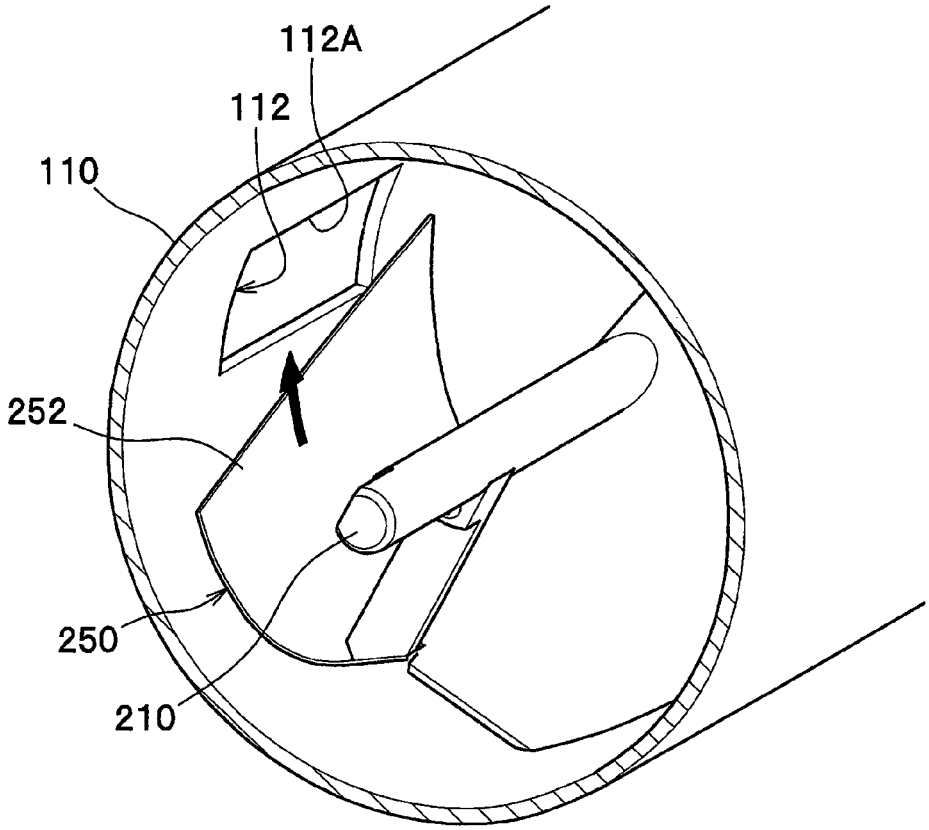
FIG. 6A is an enlarged sectional view of a return opening-side agitation blade showing the state where it is in sliding contact with an inner circumferential surface of an inside housing.
Figure 6B:
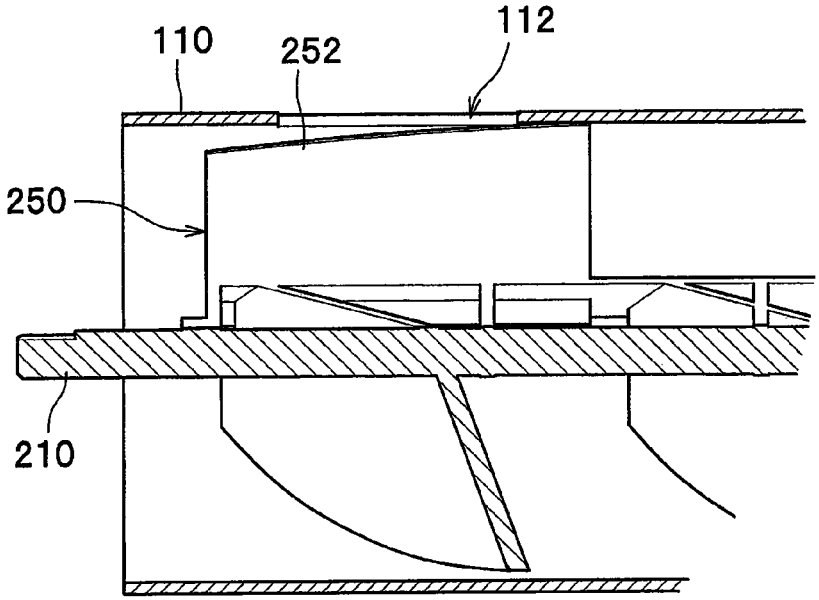
FIG. 6B is a sectional view of the return opening-side agitation blade showing the state as viewed from the above.

Next, the detailed structure of the developer cartridge 100 as an example of a developer cartridge according to the present invention will be described. In the drawings, FIG. 2 is an enlarged sectional view illustrating a detailed structure of a developer cartridge. FIG. 3A is a perspective view of the developer cartridge in a closed state, and FIG. 3B is a perspective view of the developer cartridge in an open state. FIG. 4A is a perspective view of an agitator showing the state as viewed from an oblique agitation blade side, and FIG. 4B is a perspective view of the agitator showing the state as viewed from a side opposite to the oblique agitation blade side. FIG. 5A is an enlarged sectional view of a delivery agitation blade showing the state where it is in sliding contact with an inner circumferential surface of an inside housing, FIG. 5B is a top view of the delivery agitation blade showing the state as viewed from the above, and FIG. 5C is a sectional view taken along the line V-V in FIG. 5B. FIG. 6A is an enlarged sectional view of a return opening-side agitation blade showing the state where it is in sliding contact with an inner circumferential surface of an inside housing, and FIG. 6B is a sectional view of the return opening-side agitation blade showing the state as viewed from the above.

As shown in FIG. 2, the developer cartridge 100 constitutes the process cartridge 17 together with the developing cartridge 28 and the drum unit 51 described above, and the developer cartridge 100 is detachably attached to the developing cartridge 28. Specifically, the developer cartridge 100 includes an inside housing 110 configured to accommodate developer T therein, an outside housing 120 configured to be displaced relative to the inside housing 110, and the agitator 200.

The inside housing 110 has a hollow, cylindrical shape, and is rotatably supported by a substantially cylindrical, inner circumferential surface of the outside housing 120. Moreover, a supply opening 111 for supplying the developer T to the inside of the developing cartridge 28 is formed in a portion at the side of the developing cartridge 28 of an outer circumferential wall (a wall opposite a rotation shaft 210 of the agitator 200 in the diameter direction) of the cylindrical shape of the inside housing 110. Moreover, as shown in FIG. 3B, the supply opening 111 is formed at a center portion in the axial direction of the inside housing 110. Furthermore, return openings 112 for returning the developer T from a developing chamber 28A (see FIG. 2) in the developing cartridge 28 to the inside of the developer cartridge 100 are formed at both the left and right sides (opposite positions in the axial direction of the inside housing 110) of the return opening 111.

Here, the developer T accommodated in the developer cartridge 100 is accommodated at a portion lower than the return openings 112 when the developer cartridge 100 in a non-used state is attached to the main casing 2.

The outside housing 120 has a substantially hollow, cylindrical shape, and at corresponding portions at the side of the developing cartridge 28 of an outer circumferential wall of the cylindrical shape of the outside housing 120, a supply opening 121 communicating with the supply opening 111 of the inside housing 110 and return openings 122 communicating with the return openings 112 of the inside housing 110. That is, the supply opening 121 and the return openings 122 of the outside housing 120 are formed at positions corresponding to the supply opening 111 and the return openings 112 of the inside housing 110, the three ports being arranged in the axial direction.

A gear part 130 is disposed on an end surface at one end side of the outside housing 120, the gear part 130 being fixed at an end portion of a rotation shaft 210 of the agitator 200 that is rotatably provided to the inside housing 110 and the outside housing 120. When driving force is transmitted from the side of the main casing 2 to the gear part 130, the agitator 200 is rotated.

The inside housing 110 and the outside housing 120 having the above-described construction are configured such that when developer cartridge 100 is attached to the developing cartridge 28, the outside housing 120 is fixed to the developing cartridge 28 and the inside housing 110 is rotated relative to the outside housing 120. The rotation structure is well known: to briefly describe, a projection 113 having a circular arc shape formed at an end portion of the inside housing 110 shown in FIG. 3A engages with a lever (not shown) and is moved along the circular arc shape by a lever operation, whereby the inside housing 110 is rotated relative to the outside housing 120. Moreover, in a state shown in FIG. 3A where the developer cartridge 100 is not attached thereto, the supply opening 111 and the return openings 112 of the inside housing 110 are closed by the circumferential wall of the outside housing 120. Meanwhile, in a state shown in FIG. 3B where the developer cartridge 100 is attached and the inside housing 110 is rotated, the supply opening 111 and the return openings 112 of the inside housing 110 are communicated with the supply opening 121 and the return openings 122 of the outside housing 120 so that the developer T can be supplied through the ports.

As shown in FIGS. 4A and 4B, the agitator 200 includes the rotation shaft 210, a support wall 220, an oblique agitation blade 230, a delivery agitation blade 240 as an example of a second agitation blade, and a return opening-side agitation blade 250 as an example of the first agitation blade.

As shown in FIG. 3B, the rotation shaft 210 is rotatably supported by the inside housing 110 and the outside housing 120 and is configured to pass across the inside of the inside housing 110 (specifically, the rotation shaft 210 is coaxial to the center axis of the inside housing 110).

The support wall 220 is formed integral with the rotation shaft 210 and includes a first support frame portion 221 that extends from the rotation shaft 210 toward one side in the diameter direction and a second support frame portion 222 that extends from the rotation shaft 210 toward a side opposite to the extending direction of the first support frame portion 221. The first support frame portion 221 is shorter than the second support frame portion 222 in the axial direction of the rotation shaft 210, and a portion of the support wall 220 opposite the return openings 112 (see FIGS. 3A and 3B) of the inside housing 110 has a notch shape. In addition, the first support frame portion 221 and the second support frame portion 222 have a lattice shape, and a plurality of openings 225 are formed in the support wall 220.

The oblique agitation blade 230 has a distal end thereof formed along the inner peripheral surface of the inside housing 110, and is oblique to the rotation shaft 210 over portions of the support wall 220 from the distal end of the first support frame portion 221 to the distal end of the second support frame portion 222. Specifically, two oblique agitation blades 230 (four in total) are provided on the support wall 220 with the supply opening 111 disposed between them so that a backward-side end portion 232 in the rotation direction of the rotation shaft 210 is positioned closer to the supply opening 111 (see FIGS. 3A and 3B) of the inside housing 110 than an forward-side end portion 231 in the rotation direction of the rotation shaft 210. More specifically, the forward-side end portion 231 of the oblique agitation blade 230 in the rotation direction is integrally formed on the second support frame portion 222, and the backward-side end portion 232 in the rotation direction is integrally formed on the first support frame portion 221.

The delivery agitation blade 240 is formed of flexible sheet that is elongated in the axial direction of the rotation shaft 210 and is supported by the rotation shaft 210 via the first support frame portion 221. Specifically, the delivery agitation blade 240 has a proximal end portion 241 fixed to the distal end of the first support frame portion 221, whereby a distal end portion 242 can be bent to make sliding contact with the inner circumferential surface of the inside housing 110 (see FIGS. 5A to 5C). The distal end portion 242 is divided into two parts by one slit 243, and the divided distal end portions 242A and 242B have a mound shape that is inclined toward the proximal end portion 241 as they extend from the slit 243 toward outermost ends 244. With such a structure, the bending force of the distal end portions 242A and 242B becomes the greatest at a portion close to the slit 243 and the smallest at portions close to the outermost ends 244. For this reason, as shown in FIGS. 5A and 5B, when the distal end portions 242A and 242B make sliding contact with the inner circumferential surface of the inside housing 110, ends A1 and B1 of the distal end portions 242A and 242B undergo different delay amount in the rotation direction. As a result, as shown in FIG. 5C, a concave portion 245 that is concave to the backward side in the rotation direction is formed in the delivery agitation blade 240. Here, a small gap is formed at the center portion of the concave portion 245 which is formed by bending the distal end portion 242 having the slit 243. However, the inclination angle of the ends A1 and B1 of the distal end portions 242A and 242B or the free length of the delivery agitation blade 240 is appropriately set such that the amount of developer T collected in the concave portion 245 is much greater than the amount of developer T flowing out through the gap. Therefore, the developer T can be efficiently conveyed in the concave portion 245. In addition, the slit 243 is formed at a position opposite the supply opening 111 of the inside housing 110, and therefore, the concave portion 245 can pass through the position opposite the supply opening 111 of the inside housing 110 by the rotation of the rotation shaft 210. Moreover, the delivery agitation blade 240 has the distal end portion 242 directed toward the backward side in the rotation direction of the rotation shaft 210. Therefore, the developer T accumulated in the lower half part of the inside housing 110 is pushed upward and delivered through the supply opening 111 in an efficient manner.

As shown in FIG. 4B, the return opening-side agitation blade 250 is supported by the rotation shaft 210 via the second support frame portion 222 of the support wall 220 and is disposed at a position wherein it passes through a position opposite the return openings 112 (see FIGS. 3A and 3B) of the inside housing 110. Specifically, the return opening-side agitation blade 250 has a proximal end portion 251 fixed to the distal end of the second support frame portion 222, whereby a distal end portion 252 can be bent to make sliding contact with the inner circumferential surface of the inside housing 110. Moreover, the return opening-side agitation blade 250 has the distal end portion 252 directed to the forward side in the rotation direction of the rotation shaft 210 so that the developer T returned through the return openings 112 of the inside housing 110 is taken upward and received in the inside housing 110. Furthermore, as shown in FIGS. 6A and 6B, the distal end portion 252 has a width larger than the horizontal width (a width in a direction parallel to the rotation shaft 210) of the return openings 112 of the inside housing 110 and is inclined relative to ends 112A of the return openings 112 at the forward side in the rotation direction of the rotation shaft 210.

Next, the operation of the agitator 200 according to the present invention will be described. In the drawings, FIGS. 7A and 7B are top views for illustrating an operation of the agitator, in which FIG. 7A shows the state wherein developer is accumulated on a supply opening side by an oblique agitation blade, and FIG. 7B shows the state wherein developer is delivered through the supply opening.

Figure 7A:
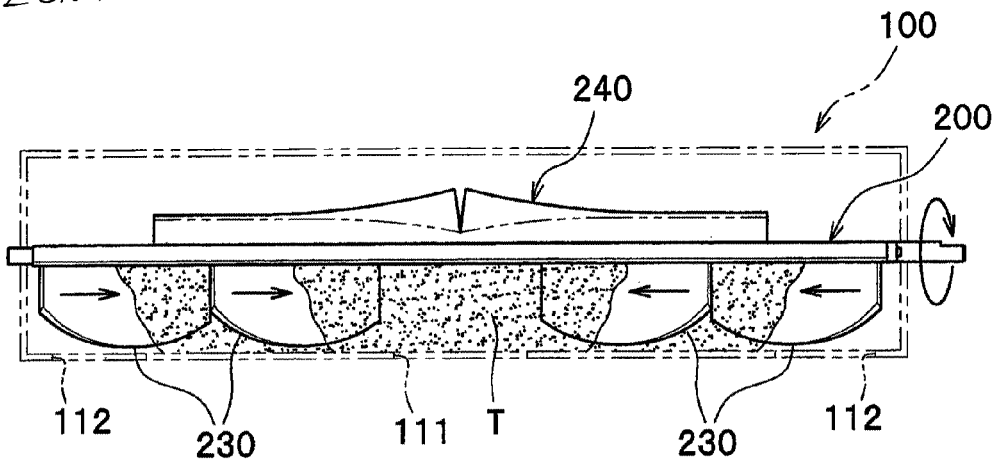

As shown in FIG. 7A, when the agitator 200 is rotated, the developer T is accumulated from the sides of the return openings 112 toward the side of the supply opening 111 by a plurality of oblique agitation blades 230, whereby the developer T is conveyed in the developer cartridge 100 from the sides of the return openings 112 to the side of the supply opening 111. Then, as shown in FIG. 7B, the developer T accumulated at the side of the supply opening 111 is accumulated by the concave portion 245 of the delivery agitation blade 240 and delivered through the supply opening 111 to the inside of the developing chamber 28A while the developer T is substantially prevented from flowing out from both ends of the delivery agitation blade 240.

In this manner, when a large amount of developer T is delivered through the supply opening 111 by the concave portion 245, the amount of the developer T in the developing chamber 28A becomes a predetermined amount or more, and the overflowing developer T is returned through the return openings 112 to the inside of the developer cartridge 100. At this time, since the notch portion (see FIGS. 4A and 4B) of the support wall 220 is disposed at the position opposite the return openings 112, the developer T can be efficiently returned through the return openings 112 to the inside of the developer cartridge 100.

Figure 7B:
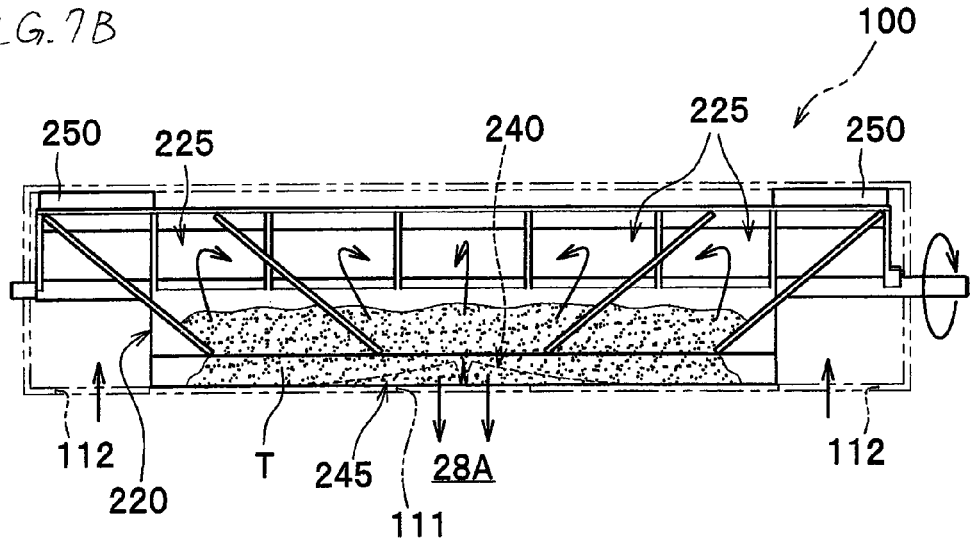

Moreover, when the agitator 200 is rotated, the return opening-side agitation blade 250 disposed at a side opposite to the return openings 112 in the state shown in FIG. 7B with the rotation shaft 210 disposed therebetween passes through the return openings 112 with the distal end portion 252 being passed first. With this movement, even though the developer T is returned through the return openings 112 to the inside of the inside housing 110 at the time of the passing, the developer T is scooped by the return opening-side agitation blade 250 and received in the inside housing 110. Moreover, since the distal end portion 252 of the return opening-side agitation blade 250 is inclined relative to the ends 112A of the return openings 112 at the forward side in the rotation direction, the return openings 250 can be passed through the return openings 112 without being blocked at the ends 112A of the return openings 112.

According to the configuration described above, the following advantages can be provided.

Since the developer T returned through the return openings 112 to the inside of the inside housing 110 is scooped by the return opening-side agitation blade 250 and received in the inside housing 110, the developer T can be efficiently returned through the return openings 112 to the inside of the inside housing 110, circulation of the developer T can be improved.

Since the distal end portion 252 of the return opening-side agitation blade 250 has a width larger than that of the return openings 112, it is possible to efficiently agitate the vicinity of the return openings 112 and to prevent the distal end portion 252 from being blocked by the return openings 112. In addition, since the distal end portion 252 of the return opening-side agitation blade 250 is inclined relative to the ends 112A of the return openings 112 at the forward side in the rotation direction, the distal end portion 252 is prevented from being blocked at the ends 112A of the return openings 112. Therefore, it is possible to prevent the distal end portion 252 from being blocked at the vicinity of the return openings 112 in a more efficient manner.

Since the developer T accommodated is accommodated at a portion lower than the return openings 112 when the developer cartridge 100 in a non-used state is attached to the main casing 2, the developer T can be efficiently returned from the developing chamber 28A to the inside of the developer cartridge 100. Therefore, circulation of the developer T can be improved.

Moreover, since the developer T is conveyed from the sides of the return openings 112 to the side of the supply opening 111 by the oblique agitation blade 230, circulation of the developer T can be improved.

Second Example

Figure 8:
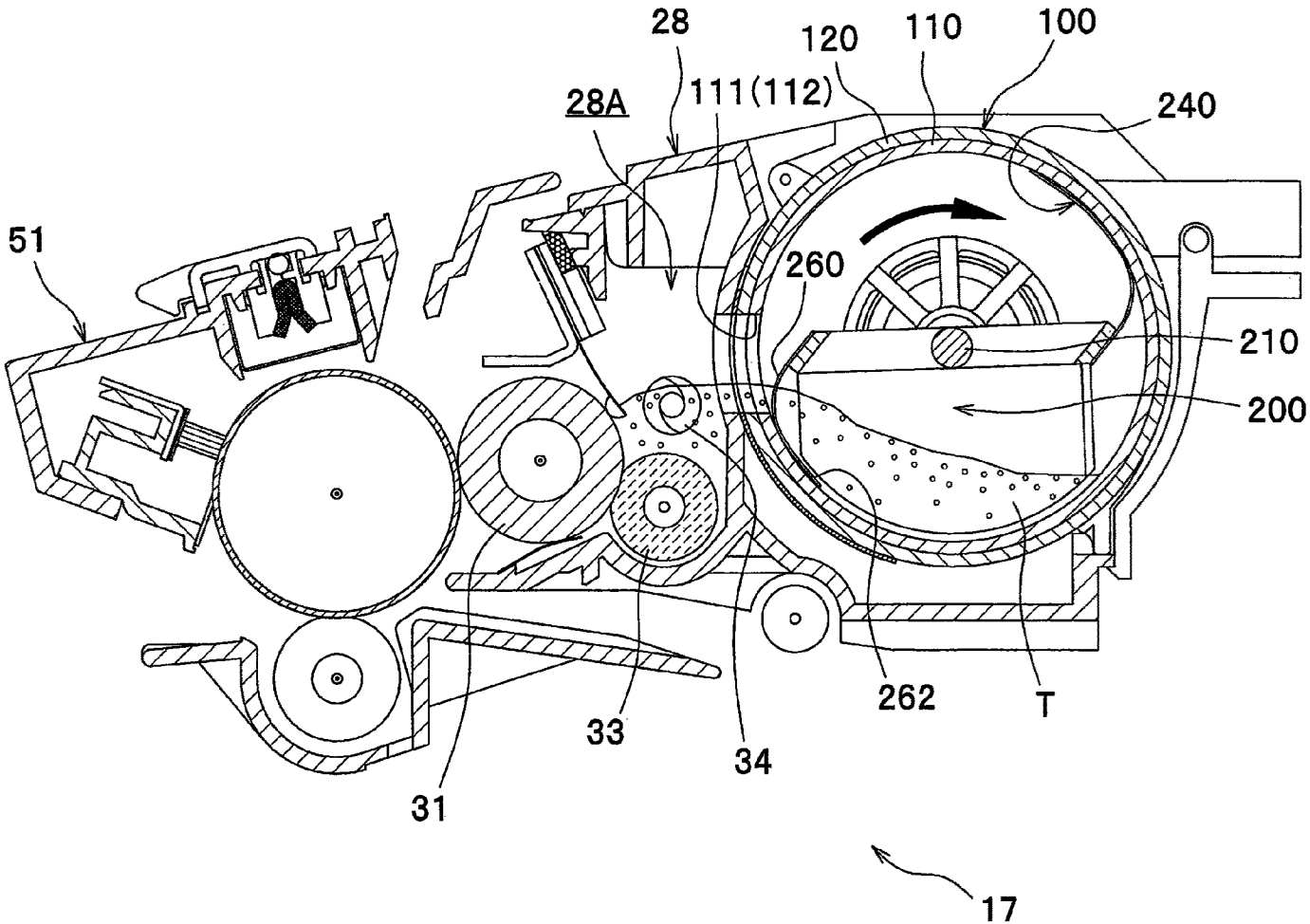
FIG. 8 is a side sectional view of a developer cartridge according to a second example of the invention.
Figure 9A:
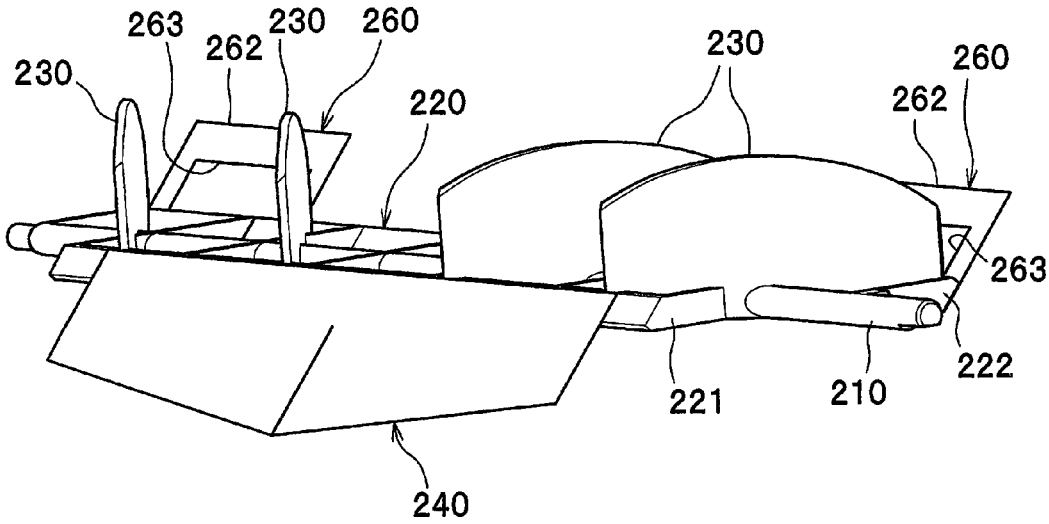
FIG. 9A is a perspective view of an agitator according to the second example showing the state as viewed from an oblique agitation blade side.
Figure 9B:
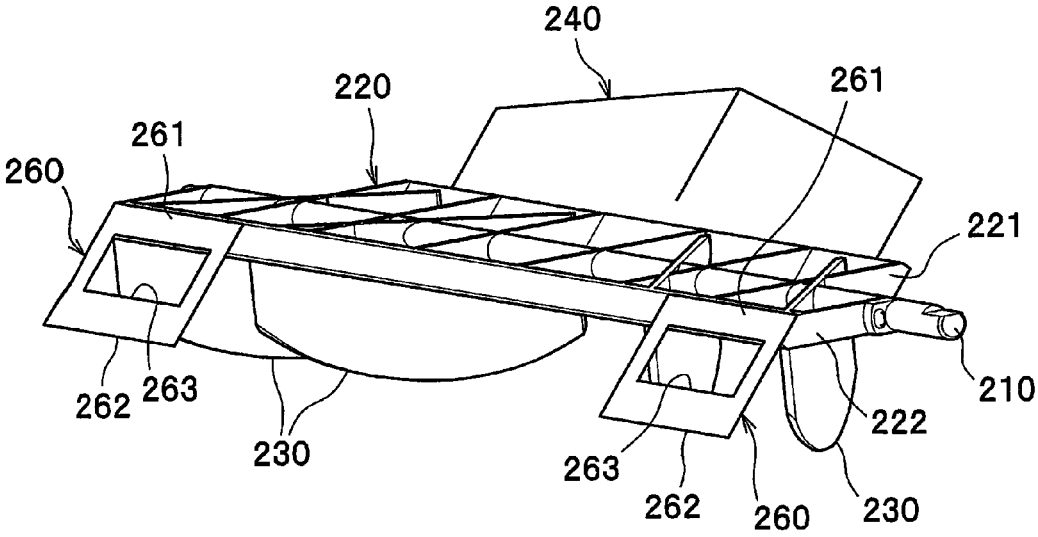
FIG. 9B is a perspective view of the agitator showing the state as viewed from a side opposite to the oblique agitation blade side.
Figure 10A:
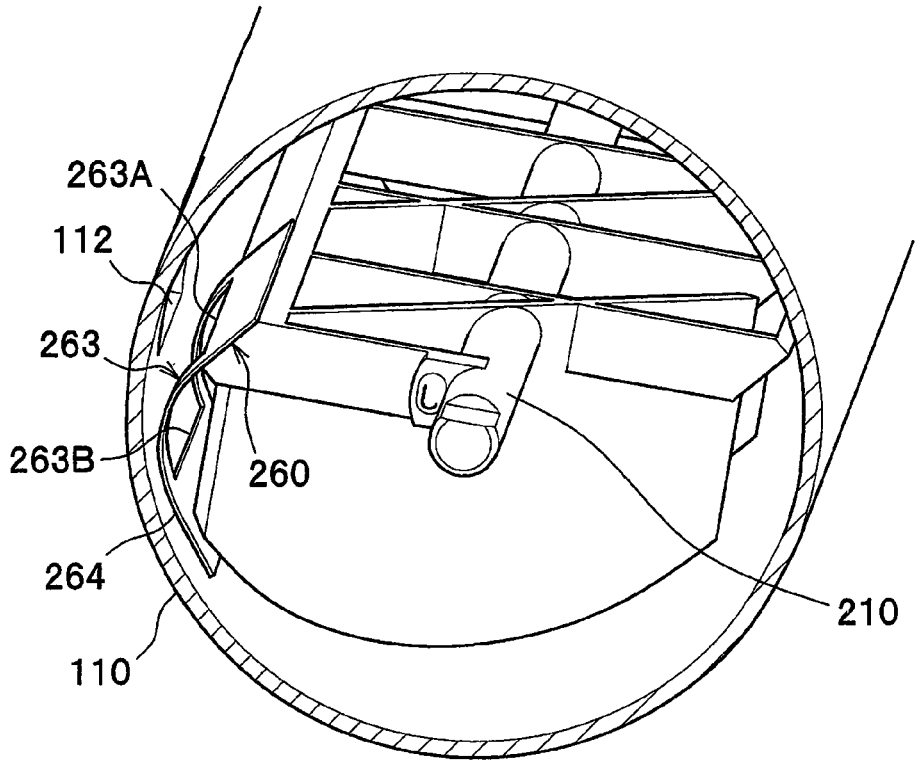
FIG. 10A is an enlarged perspective view showing the state where a return opening-side agitation blade is in sliding contact with an inner circumferential surface of an inside housing.
Figure 10B:
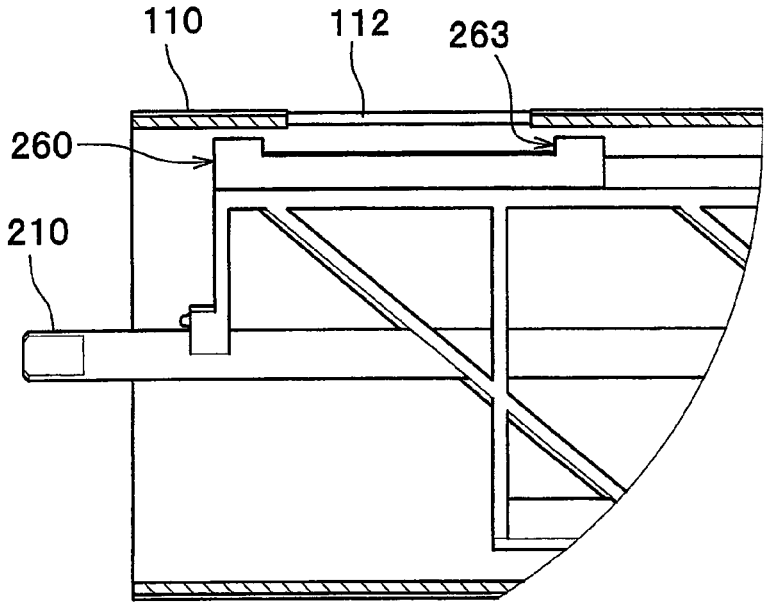
FIG. 10B is a top view of the return opening-side agitation blade showing the state as viewed from the above.

Next, a second example of the present invention will be described in detail by appropriately referring to the attached drawings. In the second example, the structure of the return opening-side agitation blade of the agitator according to the first example is modified, and the same components as the first example will be denoted by the same reference numerals and will not be described. In the drawings, FIG. 8 is a side sectional view of a developer cartridge according to the second example. FIG. 9A is a perspective view of an agitator according to the second example showing the state as viewed from an oblique agitation blade side, and FIG. 9B is a perspective view of the agitator showing the state as viewed from a side opposite to the oblique agitation blade side. FIG. 10A is an enlarged perspective view showing the state where a return opening-side agitation blade is in sliding contact with an inner circumferential surface of an inside housing, and FIG. 10B is a top view of the return opening-side agitation blade showing the state as viewed from the above.

As shown in FIG. 8, a return opening-side agitation blade 260 according to the second example is disposed such that a distal end portion 262 is directed toward the backward side in the rotation direction of the rotation shaft 210. As shown in FIGS. 9A and 9B, the return opening-side agitation blade 260 is formed of rectangular flexible sheet, and has a proximal end 261 fixed to the distal end of the second support frame portion 222, whereby the distal end portion 262 can be bent to make sliding contact with the inner circumferential surface of the inside housing 110. Moreover, a rectangular opening portion 263 as an example of an opening is formed at the center portion of the return opening-side agitation blade 260. The opening portion 263 has a size equal to or greater than the area of the return openings 112 (see FIGS. 3A and 3B) of the inside housing 110. Specifically, as shown in FIG. 10A, the opening portion 263 has a rotation shaft-side end 263A disposed close to the rotation shaft 210 and apart from the inner circumferential surface of the inside housing 110 and a housing-side end 263B disposed opposite the rotation shaft-side end 263A and at a position (a position nearest to the inner circumferential surface of the inside housing 110) of a sliding contact surface 264 of the return opening-side agitation blade 260 with the inside housing 110. As shown in FIGS. 10A and 10B, the opening portion 263 has a width larger than the horizontal width (a width in a direction parallel to the rotation shaft 210) of the return openings 112 and the vertical width (a width in a direction perpendicular to the rotation shaft 210) of the return openings 112.

According to the second example, following advantages can be provided.

Since the opening portion 263 is formed in the return opening-side agitation blade 260, the developer T returned through the return openings 112 to the inside of the inside housing 110 is passed through the opening portion 263. Therefore, it is possible to prevent the flow of the developer T from being interrupted. Accordingly, circulation of the developer T can be improved.

Since the opening portion 263 has a width larger than the horizontal and vertical width of the return openings 112, the developer T returned through the return openings 112 is easily passed through the opening portion 263. Therefore, it is possible to more efficiently prevent the flow of the developer T from being interrupted. Accordingly, circulation of the developer T can be improved.

The rotation shaft-side end 263A of the opening portion 263 is formed apart from the inner circumferential surface of the inside housing 110, and the housing-side end 263 is formed at a position of the sliding contact surface 264 of the return opening-side agitation blade 260 with the inside housing 110. Therefore, it is possible to prevent the developer T from being pushed upward and being forced out through the return openings 112 to the developing chamber 28A in a state where the developer is sandwiched between the return opening-side agitation blade 260 and the inner circumferential surface of the inside housing 110.

Modified Examples

Although the present invention has been described based on the above-described exemplary embodiments, the present invention is not limited to the above-described exemplary embodiments. It will be understood that the present inventive concept may be subjected to various improvements and modifications within the scope of the present invention.

Figure 11A:
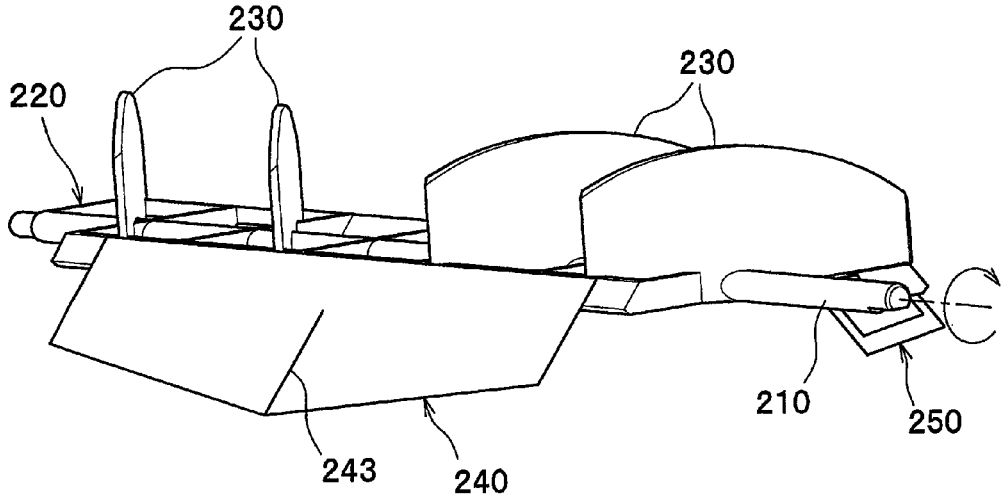
FIG. 11A is a perspective view of an agitator according to modified example showing the state as viewed from an oblique agitation blade side.
Figure 11B:
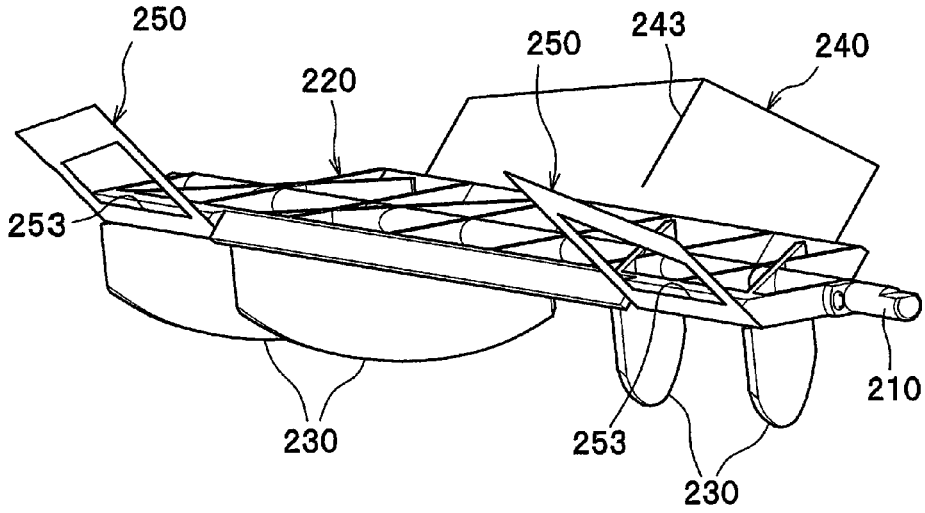
FIG. 11B is a perspective view of the agitator showing the state as viewed from a side opposite to the oblique agitation blade side.

For example, as shown in FIGS. 11A and 11B, an opening portion 253 may be formed in the return opening-side agitation blade 250 similar to the second embodiment. According thereto, it is possible to provide the advantages of the second embodiment in addition to the advantages of the first embodiment.

Further, in the above-described exemplary embodiments, the slit 243 is formed in the delivery agitation blade 240. Alternatively, the slit may not be formed. Moreover, the shape of the delivery agitation blade 240 is not limited to the mound shape as described in the embodiments. For example, a rectangular shape may also be used.

Still further, in the above-described exemplary embodiments, the delivery agitation blade 240 and the return opening-side agitation blades 250 and 260 are formed of flexible sheet. Alternatively, the delivery agitation blade 240 and the return opening-side agitation blades may be formed of non-flexible material. In such a case, the distal end of the delivery agitation blade or the return opening-side agitation blade is not in sliding contact with the inside housing but is slightly separated from the inner surface of the inside housing.

Still further, in the above-described exemplary embodiments, although the present inventive concept has been described in relation to a laser printer, the present inventive concept is not limited to any specific type of laser printer. Rather, the present inventive concept can be applied to other image forming apparatuses such as a copying machine or a multi-functional device.

Still further, in the above-described exemplary embodiments, the scanner unit 16 is employed as the exposure unit. Alternatively, an LED head may be used for example. Moreover, the structure of the conveying unit or the fixing unit may be appropriately modified.

Still further, in the above-described exemplary embodiments, although a single supply opening 111 (121) and two return openings 112 (122) are provided, the number of ports can be arbitrary. For example, one supply opening may be provided at one end side of the developer cartridge and one return opening may be provided at the other end side of the developer cartridge.

Still further, in the above-described exemplary embodiments, although a plurality of openings 225 is formed on the entire surface of the support wall 220, the openings may be formed in a portion of the support wall. Moreover, the openings may not be formed.

What is claimed is:

1. A developer cartridge comprising:

a housing configured to accommodate developer;

a rotation shaft that is rotatably supported by the housing and passes across an inside of the housing;

a supply opening formed in a wall of the housing opposite in a diameter direction of the rotation shaft;

a return opening formed in the wall of the housing at a position displaced from the supply opening in an axial direction of the rotation shaft;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to allow the developer returned through the return opening to flow into the housing; and wherein a free end of the first agitation blade is bent to make sliding contact with an inner circumferential surface of the housing and is directed toward a forward side in a rotation direction thereof.

2. The developer cartridge according to claim 1, wherein the free end of the first agitation blade has a width larger than a width of the return opening in a direction parallel to the rotation shaft, and wherein the free end of the first agitation blade is oblique to an end of the return opening at a forward side in the rotation direction of the rotation shaft.

3. The developer cartridge according to claim 1, wherein the first agitation blade comprises an opening.

4. The developer cartridge according to claim 3, wherein the opening is larger than the return opening.

5. The developer cartridge according to claim 3, wherein the opening is wider than a width of the return opening in a direction parallel to the rotation shaft, and wherein the opening is wider than a width of the return opening in a direction perpendicular to the rotation shaft.

6. The developer cartridge according to claim 3, wherein the opening comprises a first end closer to a free end of the first agitation blade and a second end opposing the first end, and wherein a distance between the opening and the inner surface of the housing increases as approaching from the first end to the second end.

7. The developer cartridge according to claim 6, wherein the first end is formed at a position of the first agitation blade nearest to the inner surface of the housing, and wherein the second end is formed at a position farthest from the inner surface of the housing.

8. The developer cartridge according to claim 1, wherein developer is accommodated in the housing at a portion lower than the return opening.

9. The developer cartridge according to claim 1, further comprising an oblique agitation blade comprising a first end portion and a second end portion in a rotation direction thereof, the second end portion being disposed on a forward side in the rotation direction, wherein the oblique agitation blade is oblique to the rotation shaft such that the first end portion is closer to the supply opening than the second end portion in the axial direction of the rotation shaft.

10. The developer cartridge according to claim 9, wherein the developer cartridge comprises a plurality of oblique agitation blades.

11. A developing device comprising:

a developer cartridge comprising:

a housing configured to accommodate developer;

a rotation shaft that is rotatably supported by the housing and passes across an inside of the housing;

a supply opening formed in a wall of the housing opposite in a diameter direction of the rotation shaft;

a return opening formed in the wall of the housing at a position displaced from the supply opening in an axial direction of the rotation shaft;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to allow the developer returned through the return opening to flow into the housing, and wherein a free end of the first agitation blade is bent to make sliding contact with an inner circumferential surface of the housing and is directed toward a forward side in a rotation direction thereof;

a developing chamber to which developer is supplied through a supply opening of the developer cartridge;

a supply roller provided in the developing chamber; and a developing roller to which the developer is supplied from the supply roller.

12. A process cartridge comprising:

a developing device comprising:

a developer cartridge comprising:

a housing configured to accommodate developer;

a rotation shaft that is rotatably supported by the housing and passes across an inside of the housing;

a supply opening formed in a wall of the housing opposite in a diameter direction of the rotation shaft;

a return opening formed in the wall of the housing at a position displaced from the supply opening in an axial direction of the rotation shaft;

a first agitation blade that is supported by the rotation shaft and is configured to pass through a position opposite the return opening along an inner surface of the housing by rotation of the rotation shaft; and a second agitation blade that is supported by the rotation shaft and is configured to pass through a position opposite the supply opening along an inner surface of the housing by the rotation of the rotation shaft, wherein the first agitation blade is configured to allow the developer returned through the return opening to flow into the housing, and wherein a free end of the first agitation blade is bent to make sliding contact with an inner circumferential surface of the housing and is directed toward a forward side in a rotation direction thereof;

a developing chamber to which developer is supplied through a supply opening of the developer cartridge;

a supply roller provided in the developing chamber;

a developing roller to which the developer is supplied from the supply roller; and a photosensitive drum to which the developer is supplied from the developing roller.

* * * * *